US009409277B2

(12) United States Patent
Umemoto et al.

(10) Patent No.: US 9,409,277 B2
(45) Date of Patent: Aug. 9, 2016

(54) POLISHING APPARATUS AND POLISHING METHOD

(71) Applicant: EBARA CORPORATION, Tokyo (JP)

(72) Inventors: Masao Umemoto, Tokyo (JP); Tadakazu Sone, Tokyo (JP); Hideo Aizawa, Tokyo (JP); Ryuichi Kosuge, Tokyo (JP); Masaaki Eriguchi, Tokyo (JP)

(73) Assignee: Ebara Corporation, Tokyo (JP)

( * ) Notice: Subject to any disclaimer, the term of this patent is extended or adjusted under 35 U.S.C. 154(b) by 366 days.

(21) Appl. No.: 14/067,723

(22) Filed: Oct. 30, 2013

(65) Prior Publication Data

US 2014/0162536 A1 Jun. 12, 2014

(30) Foreign Application Priority Data

Oct. 31, 2012 (JP) ..... 2012-240394
Nov. 2, 2012 (JP) ..... 2012-242951

(51) Int. Cl.
*B24B 53/017* (2012.01)
*B24B 37/04* (2012.01)

(52) U.S. Cl.
CPC ..... *B24B 53/017* (2013.01); *B24B 37/04* (2013.01)

(58) Field of Classification Search
CPC .. B24B 53/007; B24B 53/0095; B24B 55/02; B24B 55/03; B24B 55/12; B24B 55/045; B23D 59/02; B23D 59/025; B23D 59/04
USPC ..... 451/56, 72, 443, 444, 450, 451, 488; 222/108
See application file for complete search history.

(56) References Cited

U.S. PATENT DOCUMENTS 5,839,947 A * 11/1998 Kimura ..... B24B 53/017 451/287
6,280,299 B1 8/2001 Kennedy et al.
6,283,840 B1 * 9/2001 Huey ..... B24B 57/02 451/288
6,358,124 B1 * 3/2002 Koga ..... B08B 1/007 451/444
6,609,962 B1 * 8/2003 Wakabayashi ..... B24B 1/04 451/443
7,753,761 B2 * 7/2010 Fujita ..... B24B 37/04 451/443
2002/0164932 A1 * 11/2002 Kamimura ..... B24B 29/005 451/56
2003/0143933 A1 * 7/2003 Baek ..... B24B 55/02 451/67
2003/0143937 A1 * 7/2003 Peng ..... B24B 37/34 451/490
2009/0067959 A1 * 3/2009 Takahashi ..... B24B 37/345 414/226.01
2009/0305612 A1 12/2009 Miyazaki et al.

(Continued)

FOREIGN PATENT DOCUMENTS

JP 2003-133277 A 5/2003
JP 2007-168039 A 7/2007

(Continued)

*Primary Examiner* — Monica Carter
*Assistant Examiner* — Marcel Dion
(74) *Attorney, Agent, or Firm* — Baker & Hostetler LLP

(57) ABSTRACT

A polishing apparatus includes: a rotatable polishing table for supporting a polishing pad having a polishing surface; a top ring head having a top ring; a top ring head cover surrounding the top ring head; a dresser head having a dresser configured to dress the polishing surface; a dresser head cover surrounding the dresser head; a spray nozzle configured to spray a cleaning liquid onto an upper surface of the top ring and an outer surface of the top ring head cover when the top ring is in the substrate transfer position; and a spray nozzle configured to spray a cleaning liquid onto an outer surface of the dresser head cover when the dresser is in the retreated position.

6 Claims, 13 Drawing Sheets

(56) References Cited

U.S. PATENT DOCUMENTS

2010/0273401 A1* 10/2010 Shiratani ..... B24B 53/017
451/56
2013/0023186 A1* 1/2013 Motoshima ..... B24B 55/02
451/7

FOREIGN PATENT DOCUMENTS

JP 2007168039 A * 7/2007
JP 2008-296293 A 12/2008
JP 2008296293 A * 12/2008

* cited by examiner

POLISHING APPARATUS AND POLISHING METHOD

CROSS REFERENCE TO RELATED APPLICATIONS

This document claims priorities to Japanese Patent Application Number 2012-240394, filed Oct. 31, 2012 and Japanese Patent Application Number 2012-242951, filed Nov. 2, 2012, the entire contents of which are hereby incorporated by reference.

BACKGROUND OF THE INVENTION

1. Field of the Invention

The present invention relates to a polishing apparatus and a polishing method, and more particularly to a polishing apparatus and a polishing method for polishing and planarizing a surface of a polishing object (substrate), such as a wafer, while preventing the formation of scratches on the surface of the polishing object, caused by a polishing liquid that has been scattered and dried.

The present invention also relates to a polishing apparatus, and more particularly to a polishing apparatus for polishing and planarizing a surface of a polishing object (substrate), such as a wafer, while preventing a polishing liquid from contaminating various covers and other parts disposed around a polishing table.

2. Description of the Related Art

A polishing apparatus for polishing a wafer surface generally includes a polishing table for supporting a polishing pad having a polishing surface, and a top ring (or a polishing head) for holding a wafer. While the polishing table and the top ring are moved relative to each other, the wafer, held by the top ring, is pressed against the polishing surface of the polishing pad at a predetermined pressure to come into sliding contact with the polishing surface. As a result, the wafer is polished to have a flat mirror surface. In the case of chemical mechanical polishing (CMP), a polishing liquid (or slurry) is supplied onto the polishing pad during polishing.

When the surface of the substrate, such as a wafer, is polished while the polishing liquid is supplied to the polishing pad, the polishing liquid is scattered around the polishing table. After the polishing of the substrate, a liquid (e.g., pure water) or a mixed fluid of a liquid (e.g., pure water) and a gas (e.g., nitrogen gas) is sprayed in a mist state from an atomizer to the polishing surface of the polishing pad to clean the polishing surface. During the cleaning of the polishing surface by means of the atomizer, the polishing liquid remaining on the polishing surface is also scattered around the polishing table. The scattered polishing liquid can be attached to and dried on various constituent parts disposed around the polishing table or on an inner surface of a chamber in which the polishing apparatus is housed. If the dried polishing liquid falls onto the polishing table, the fallen matters may cause a scratch on the substrate.

In general, various cleaning nozzles are disposed in predetermined positions in the polishing apparatus. A cleaning liquid is periodically emitted from the cleaning nozzles toward predetermined sites in the polishing apparatus in order to rinse off the polishing liquid that has been attached to the polishing table or the surfaces of constituent parts disposed around the polishing table. However, despite the rinsing with the cleaning liquid, some polishing liquid may remain and be dried on the surfaces of the constituent parts disposed around the polishing table. Once the polishing liquid is attached to and dried on the surfaces of the constituent parts, it is difficult to rinse off the dried polishing liquid with the cleaning liquid. Moreover, if the dried polishing liquid is deposited repeatedly, the dried polishing liquid may fall onto the polishing pad, thus causing a scratch on the substrate.

A top ring head cover that surrounds a top ring head having the top ring may be employed to protect the top ring head from the scattered polishing liquid. The polishing apparatus typically includes a dresser for dressing the polishing surface. A dressing head cover that surrounds a dressing head having the dresser may be employed to protect the dressing head from the scattered polishing liquid. Further, an atomizer cover that surrounds spray nozzle(s) of the atomizer may be employed to prevent dispersion of the mixed fluid or the polishing liquid that has bounced off the polishing pad.

The atomizer cover generally has a fairly complicated shape. As a result, a liquid containing the polishing liquid, which has bounced off the polishing pad, is likely to stay in the atomizer cover. In addition, since the atomizer cover has a number of corners where the liquid is likely to remain, it is generally difficult to clean an external surface of the atomizer cover with a cleaning liquid. If the liquid containing the polishing liquid is attached to and solidified on the atomizer cover, the solid matter may fall onto the polishing surface, thus contaminating the polishing surface.

It is difficult to completely prevent the scattered polishing liquid from flowing into the top ring head cover. Thus, the polishing liquid may enter the interior of the top ring head cover and stay there, thus contaminating the top ring head cover or the top ring head. Further, the polishing liquid may drop from the top ring head cover onto the polishing surface, thus contaminating the polishing surface.

SUMMARY OF THE INVENTION

It is a first object of the present invention to provide a polishing apparatus and a polishing method which can prevent a polishing liquid, scattered around a polishing table e.g., during polishing of a substrate, from being attached to and dried on surfaces of various constituent parts disposed around the polishing table to thereby prevent formation of scratches on a substrate surface.

It is a second object of the present invention to provide a polishing apparatus having an atomizer cover which can prevent a liquid, which has bounced off a polishing surface, from remaining on an inner surface of the atomizer cover, which is relatively easy to be cleaned with a cleaning liquid, and which can prevent a solid matter from falling onto and contaminating the polishing surface.

It is a third object of the present invention to provide a polishing apparatus having a top ring head cover which can prevent a polishing liquid from contaminating the top ring head cover or a top ring head even if the polishing liquid has entered the interior of the top ring head cover, and in addition can prevent the polishing liquid from dropping onto and contaminating a polishing surface.

An embodiment of the polishing apparatus includes: a rotatable polishing table for supporting a polishing pad having a polishing surface; a top ring head having a top ring configured to press a substrate against the polishing surface, the top ring being movable between a polishing position above the polishing table and a substrate transfer position beside the polishing table; a top ring head cover surrounding the top ring head; a dresser head having a dresser configured to dress the polishing surface, the dresser being movable between a dressing position above the polishing table and a retreated position beside the polishing table; a dresser head cover surrounding the dresser head; a spray nozzle configured to spray a cleaning liquid onto an upper surface of the top ring and an outer surface of the top ring head cover when the top ring is in the substrate transfer position; and a spray nozzle configured to spray a cleaning liquid onto an outer surface of the dresser head cover when the dresser is in the retreated position.

According to the above-described embodiment, when the top ring is in the substrate transfer position, the cleaning liquid is sprayed from the spray nozzle onto the upper surface of the top ring and the outer surface of the top ring head cover to keep these surfaces in a wet state. Further, when the dresser is in the retreated position, the cleaning liquid is sprayed from the spray nozzle onto the outer surface of the dresser head cover to keep this outer surface in a wet state. The polishing liquid can therefore be prevented from being attached to and dried on the upper surface of the top ring, the outer surface of the top ring head cover, and the outer surface of the dresser head cover.

In a preferred embodiment, the polishing apparatus may further include: an atomizer configured to spray a cleaning fluid onto the polishing surface to clean the polishing surface; and a spray nozzle configured to spray a cleaning liquid onto an outer surface of the atomizer.

According to this embodiment, the cleaning liquid is sprayed from the spray nozzle onto the outer surface of the atomizer when a substrate is not being polished, e.g., when the polishing surface is being cleaned with the cleaning fluid sprayed from the atomizer, or when the polishing surface is being dressed by the dresser. By thus keeping the outer surface of the atomizer in a wet state with the cleaning liquid, the polishing liquid can be prevented from being attached to and dried on the surface.

In a preferred embodiment, the polishing apparatus may further include a polishing liquid supply nozzle configured to supply a polishing liquid onto the polishing surface; and a spray nozzle configured to spray a cleaning liquid onto the polishing liquid supply nozzle.

According to this embodiment, the cleaning liquid is sprayed from the spray nozzle onto the polishing liquid supply nozzle when the substrate is not being polished, e.g., when the polishing surface is being cleaned with the cleaning fluid sprayed from the atomizer or when the polishing surface is being dressed by the dresser. By thus keeping the outer surface of the polishing liquid supply nozzle in a wet state with the cleaning liquid, the polishing liquid can be prevented from being attached to and dried on the surface.

In a preferred embodiment, the polishing apparatus may further include a spray nozzle configured to spray a cleaning liquid onto an inner surface of a chamber in which the polishing apparatus is housed.

According to this embodiment, the cleaning liquid is sprayed from the spray nozzle onto the inner surface of the chamber when the substrate is not being polished. By thus keeping the inner surface of the chamber in a wet state with the cleaning liquid, the polishing liquid can be prevented from being attached to and dried on the surface.

Another embodiment of the polishing method includes moving a top ring, holding a substrate, to a polishing position above a polishing table; rotating the polishing table; pressing the substrate against a polishing surface of a polishing pad on the polishing table by the top ring while supplying a polishing liquid from a polishing liquid supply nozzle onto the polishing surface to polish the substrate; moving the top ring, holding the polished substrate, from the polishing position to a substrate transfer position beside the polishing table; and spraying a cleaning liquid onto an upper surface of the top ring and an outer surface of a top ring head cover surrounding a top ring head having the top ring.

In a preferred embodiment, the polishing method may further include: moving a dresser to a dressing position above the polishing table when the top ring is in the substrate transfer position; pressing the dresser against the polishing surface to dress the polishing surface; moving the dresser from the dressing position to a retreated position beside the polishing table; and spraying a cleaning liquid onto an outer surface of a dresser head cover surrounding a dresser head having the dresser.

In a preferred embodiment, the polishing method may further include spraying a cleaning fluid from an atomizer onto the polishing surface to clean the polishing surface while spraying a cleaning liquid onto an outer surface of the atomizer when the substrate is not being polished.

In a preferred embodiment, the polishing method may further include spraying a cleaning liquid onto the polishing liquid supply nozzle when the substrate is not being polished.

Still another embodiment of the polishing apparatus includes: a rotatable polishing table for supporting a polishing pad having a polishing surface; an atomizer head configured to spray a cleaning fluid onto the polishing surface to clean the polishing surface; and an atomizer cover that covers an upper surface of the atomizer head. The atomizer cover includes a semicylindrical top plate having a semicylindrical shape, and a first side plate and a second side plate extending downward from both lower ends of the semicylindrical top plate. The semicylindrical top plate includes a first top plate having a vertical cross section in a shape of arc whose radius is constant over its entire length from a base end to a distal end of the atomizer cover, and a second top plate having a vertical cross section in a shape of arc whose radius decreases gradually from the base end toward the distal end of the atomizer cover. The first top plate and the second top plate are connected to each other at their top portions to constitute the semicylindrical top plate.

According to this embodiment, the atomizer cover has a smooth shape with no angular portion so that a liquid, which has come into contact with the inner or outer surface, will easily run down. Such a shape can prevent the contamination of the atomizer cover with a liquid containing the polishing liquid. Even if a liquid containing the polishing liquid has adhered to the atomizer cover, the liquid can be easily removed. It therefore becomes possible to prevent a liquid containing the polishing liquid from being solidified on the inner surface or the outer surface of the atomizer cover, thereby preventing a solid matter from falling onto and contaminating the polishing surface.

In a preferred embodiment, the semicylindrical top plate, the first side plate, and the second side plate are formed integrally from resin.

The atomizer cover, because of its smooth shape with no angular portion, can be produced by integral molding of a resin.

In a preferred embodiment, the semicylindrical top plate, the first side plate, and the second side plate are formed integrally from resin.

According to the embodiment, the atomizer cover can be designed so that a liquid, which has flowed down the semicylindrical top plate and one of the side plates, and reached the lower end surface of the side plate, is allowed to flow on the lower end surface in a direction from the distal end to the base end of the atomizer cover.

In a preferred embodiment, the second side plate is connected to the second top plate, and the second side plate is provided with a projecting portion projecting in a horizontal direction.

By providing the projecting portion integrally to the second side plate, the atomizer cover can be reinforced with the projecting portion. Furthermore, the projecting portion can prevent the disperse of the liquid.

In a preferred embodiment, the polishing apparatus may further include a top ring head having a top ring configured to press a substrate against the polishing surface while holding and rotating the substrate; and a top ring head cover surrounding the top ring head. The top ring head cover includes a side cover that surrounds the top ring head, and a lower cover that closes a bottom opening of the side cover. The lower cover includes a bottom plate inclined downwardly toward a radially outward direction of the polishing table when the top ring is in a polishing position above the polishing table.

According to this embodiment, the polishing liquid that has entered the interior of the top ring head cover reaches the bottom plate of the lower cover, flows on the inclined bottom plate, and is collected at a place lying beside the polishing table. This can prevent the polishing liquid from contaminating the top ring head cover and the top ring head, and dropping onto and contaminating the polishing surface.

In a preferred embodiment, the lower cover includes a side plate which extends upwardly from a peripheral portion of the bottom plate and which is in contact with or in proximity to a side plate of the side cover.

According to this embodiment, a coupling portion between the side cover and the lower cover can be located at a higher position than a corner between the side cover and the lower cover. This configuration can prevent the polishing liquid from remaining in the corner.

According to the above-described polishing apparatus, constituent parts disposed around the polishing table, such as the upper surface of the top ring, the outer surface of the top ring head cover, and the outer surface of the dresser head cover, can be kept in a wet state. Therefore, it is possible to prevent the polishing liquid from being attached to and dried on the constituent parts to thereby prevent the dried polishing liquid from falling onto the polishing table and causing a scratch on the substrate.

The above-described polishing apparatus can prevent the contamination of the atomizer cover with a liquid containing the polishing liquid. Even if a liquid containing the polishing liquid has adhered to the atomizer cover, the liquid can be easily removed. It therefore becomes possible to prevent a liquid containing the polishing liquid from being solidified on the inner surface or the outer surface of the atomizer cover to thereby prevent a solid matter from falling onto and contaminating the polishing surface. Further, even if the polishing liquid has entered the interior of the atomizer cover, the polishing liquid can be prevented from contaminating the top ring head cover or the top ring head and, in addition, can be prevented from dropping onto and contaminating the polishing surface.

DETAILED DESCRIPTION OF PREFERRED EMBODIMENTS

Figure 1:
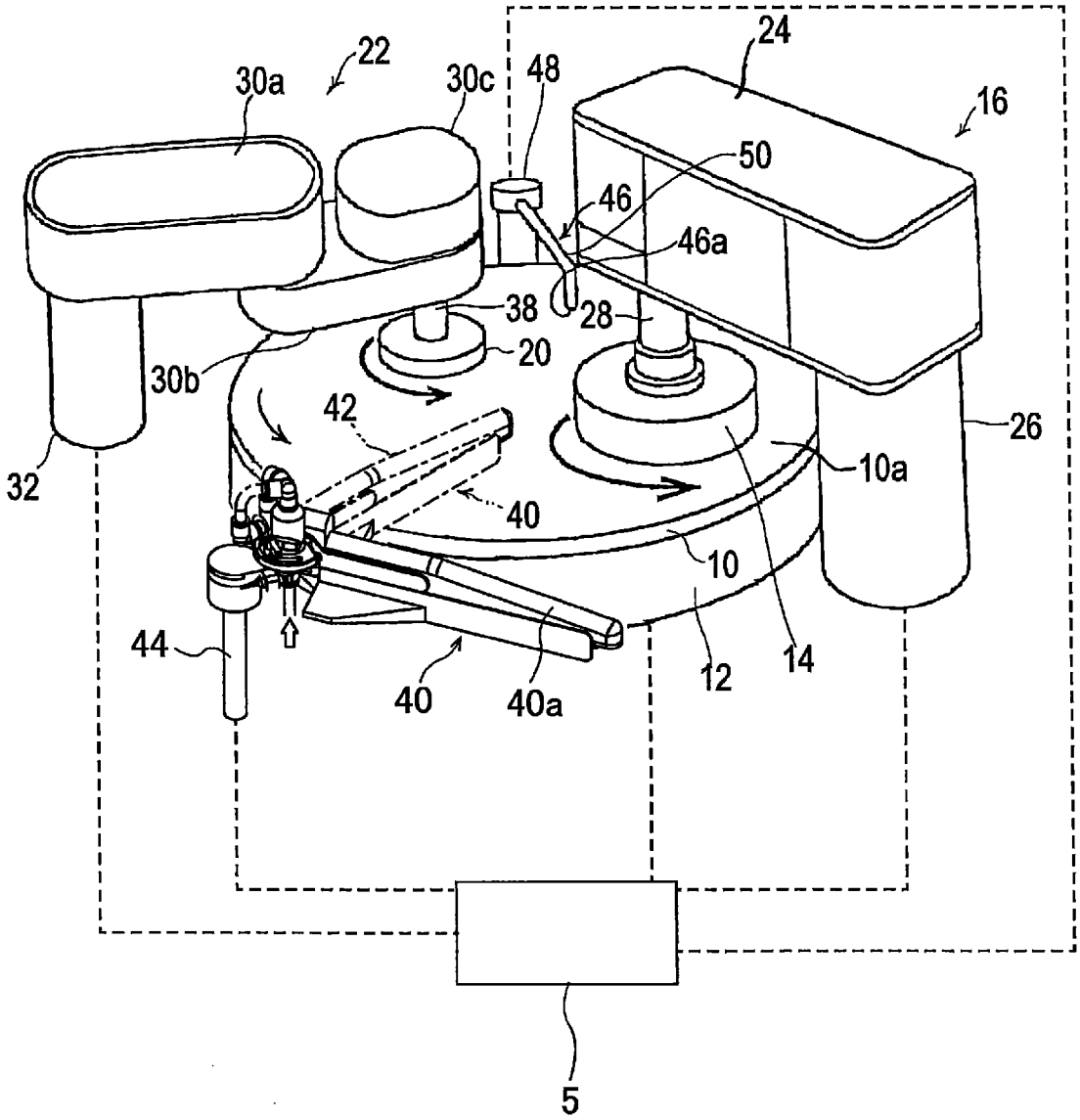
FIG. 1 is a perspective view showing a polishing apparatus according to an embodiment of the present invention when a top ring is in a polishing position above a polishing table and a dresser is in a dressing position above the polishing table.

Embodiments of the present invention will now be described with reference to the drawings. FIG. 1 is a perspective view of a polishing apparatus according to an embodiment of the present invention. FIG. 1 shows the polishing apparatus when a top ring 14 is in a polishing position above a polishing table 12 and a dresser 20 is in a dressing position above the polishing table 12. Depiction of spray nozzles is omitted in FIG. 1.

As shown in FIG. 1, the polishing apparatus includes a polishing pad 10 whose upper surface serves as a polishing surface 10*a*, a polishing table 12 with the polishing pad 10 attached to an upper surface thereof, a top ring head 16 having a top ring 14 for bringing a substrate (polishing object), such as a wafer, into sliding contact with the polishing surface (upper surface) 10*a* of the polishing pad 10 to polish the substrate, and a dresser head 22 having a dresser 20 for conditioning (or dressing) the polishing surface 10*a* of the polishing pad 10. The polishing table 12 is coupled to a not-shown motor, so that the polishing table 12 and the polishing pad 10 are rotated in a direction shown by arrow by means of the motor.

Elements of the top ring head 16, excepting the top ring 14, are surrounded by a top ring head cover 24. The top ring head 16 is coupled to an upper end of a rotatable top ring head pivot shaft 26. This top ring head pivot shaft 26 extends upward through a bottom plate of the top ring head cover 24. The top ring 14 is coupled to a lower end of a top ring drive shaft 28 that extends downward through the bottom plate of the top ring head cover 24. The top ring 14 has a lower surface that constitutes a substrate holding surface for holding a substrate by e.g., vacuum suction.

Figure 2:
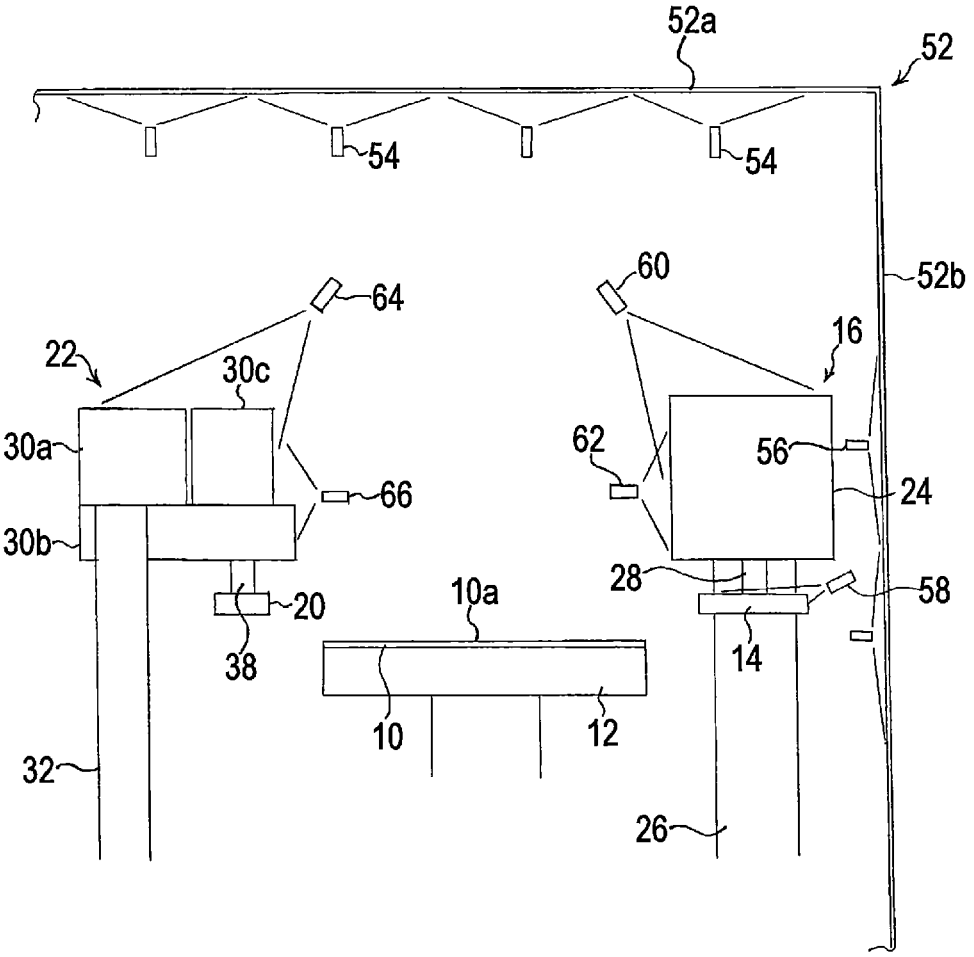
FIG. 2 is a front view showing the polishing apparatus of FIG. 1, together with spray nozzles, when the top ring is in a substrate transfer position beside the polishing table and the dresser is in a retreated position beside the polishing table.
Figure 3:
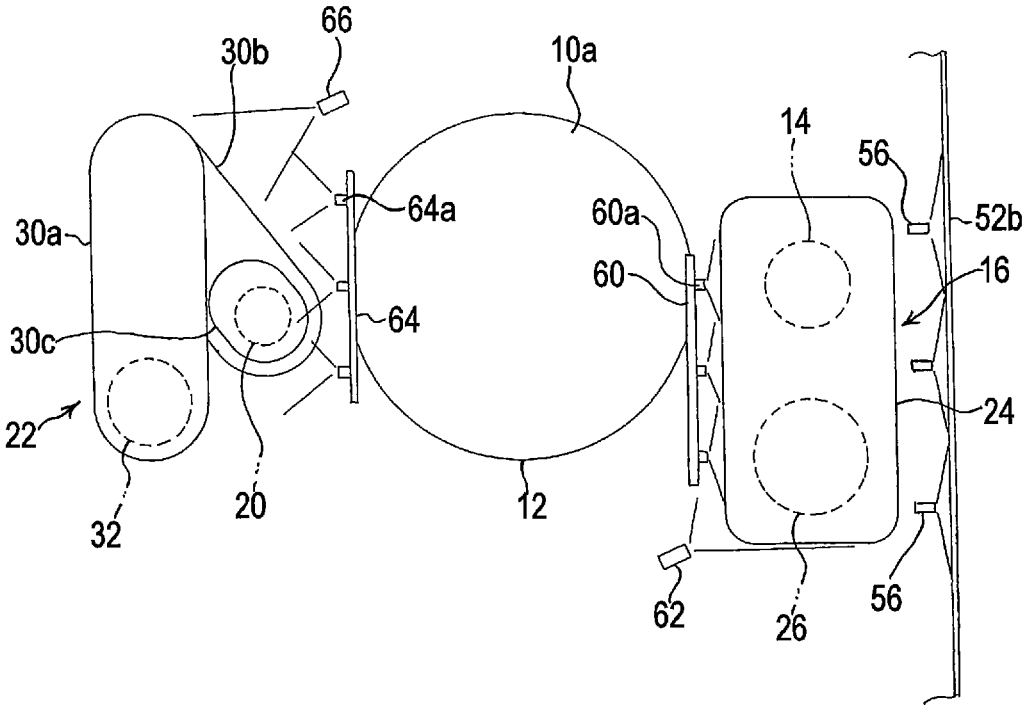
FIG. 3 is a plan view showing the polishing apparatus of FIG. 1, together with the spray nozzles, when the top ring is in the substrate transfer position beside the polishing table and the dresser is in the retreated position beside the polishing table.

As the top ring head 16 pivots by the rotation of the top ring head pivot shaft 26, the top ring 14 moves between the polishing position just above the polishing table 12, shown in FIG. 1, and a substrate transfer position beside the polishing table 12, shown in FIGS. 2 and 3.

Elements of the dresser head 22, excepting the dresser 20, are surrounded by three dresser head covers: a first dresser head cover 30*a*; a second dresser head cover 30*b*; and a third dresser head cover 30*c*. The dresser head 22 is coupled to an upper end of a rotatable dresser head pivot shaft 32 that extends upward through a bottom plate of the first dresser head cover 30*a*. The dresser 20 is coupled to a lower end of a dresser drive shaft 38 that extends downward through a bottom plate of the second dresser head cover 30*b*.

As the dresser head 22 pivots by the rotation of the dresser head pivot shaft 32, the dresser 20 moves between the dressing position just above the polishing table 12, shown in FIG. 1, and a retreated position beside the polishing table 12, shown in FIGS. 2 and 3.

An atomizer 40 is disposed adjacent to the polishing table 12. The atomizer 40 is configured to spray (or eject) a cleaning fluid, such as a liquid (e.g., pure water) or a mixed fluid of a liquid (e.g., pure water) and a gas (e.g., nitrogen gas), in a mist form onto the polishing surface 10*a* of the polishing pad 10 so as to clean the polishing surface 10*a*. The atomizer 40 has its upper surface composed of an atomizer cover 42. A large number of jet orifices (not shown) for emitting the cleaning fluid downward are provided in a lower surface of the atomizer 40 at predetermined intervals along a longitudinal direction of the atomizer 40. The atomizer 40 is coupled to an upper end of an atomizer pivot shaft 44 so that, as the atomizer pivot shaft 44 rotates, the atomizer 40 pivots between a retreated position beside the polishing table 12, shown by solid line in FIG. 1, and a cleaning position above the polishing table 12, shown by imaginary line in FIG. 1.

A polishing liquid supply nozzle 46 is disposed adjacent to the polishing table 12. The polishing liquid supply nozzle 46 is configured to supply a polishing liquid (or slurry) through a supply orifice 46*a*, which is provided at a distal end thereof, onto the polishing surface 10*a* of the polishing pad 10. The polishing liquid supply nozzle 46 is coupled to an upper end of a nozzle pivot shaft 48 so that, as the nozzle pivot shaft 48 rotates, the polishing liquid supply nozzle 46 pivots between a polishing liquid supply position, shown in FIG. 1, where the supply orifice 46*a* is located above the polishing table 12 and a retreated position (not shown) where the supply orifice 46*a* is located beside the polishing table 12. In this embodiment the polishing liquid supply nozzle 46 is constituted by a single pipe 50 and a plurality of polishing liquid tubes housed in the pipe 50.

The polishing table 12, the top ring head 16, the dresser head 22, the atomizer 40, and the polishing liquid supply nozzle 46 are coupled to an operation controller 5, which is configured to control the operations of these elements.

As shown in FIGS. 2 and 3, the polishing apparatus is housed in a chamber 52. Spray nozzles are disposed in the chamber 52 for spraying a cleaning liquid, such as pure water, onto an inner surface of the chamber 52. More specifically, the spray nozzles include ceiling spray nozzles 54 for spraying a cleaning liquid onto a ceiling 52*a* and surrounding wall spray nozzles 56 for spraying a cleaning liquid onto a surrounding wall 52*b*.

A top ring spray nozzle 58 is disposed in the chamber 52. This top ring spray nozzle 58 is configured to spray a cleaning liquid onto the upper surface of the top ring 14 when the top ring 14 is in the substrate transfer position beside the polishing table 12. The top ring spray nozzle 58 is disposed obliquely above the top ring 14 in the substrate transfer position. Further, spray nozzles for spraying a cleaning liquid onto the outer surface of the top ring head cover 24 are disposed in the chamber 52. More specifically, an upper spray nozzle 60 is provided for spraying a cleaning liquid onto a polishing-table-side surface of the top ring head cover 24 from obliquely above, and a side spray nozzle 62 is provided for spraying a cleaning liquid horizontally toward the polishing-table-side surface of the top ring head cover 24. The upper spray nozzle 60 has a large number of jet orifices 60*a* arranged horizontally along a longitudinal direction of the upper spray nozzle 60.

Further, spray nozzles are disposed in the chamber 52 for spraying a cleaning liquid onto the outer surfaces of the dresser head covers 30*a*, 30*b*, 30*c* when the dresser 20 is in the retreated position beside the polishing table 12. More specifically, an upper spray nozzle 64 is provided for spraying a cleaning liquid onto polishing-table-side surfaces of the dresser head covers 30*a*, 30*b*, 30*c* from obliquely above, and a side spray nozzle 66 is provided for spraying a cleaning liquid horizontally toward the polishing-table-side surfaces of the dresser head covers 30*a*, 30*b*, 30*c*. The upper spray nozzle 64 has a large number of jet orifices 64*a* arranged horizontally along a longitudinal direction of the upper spray nozzle 64.

Figure 4:
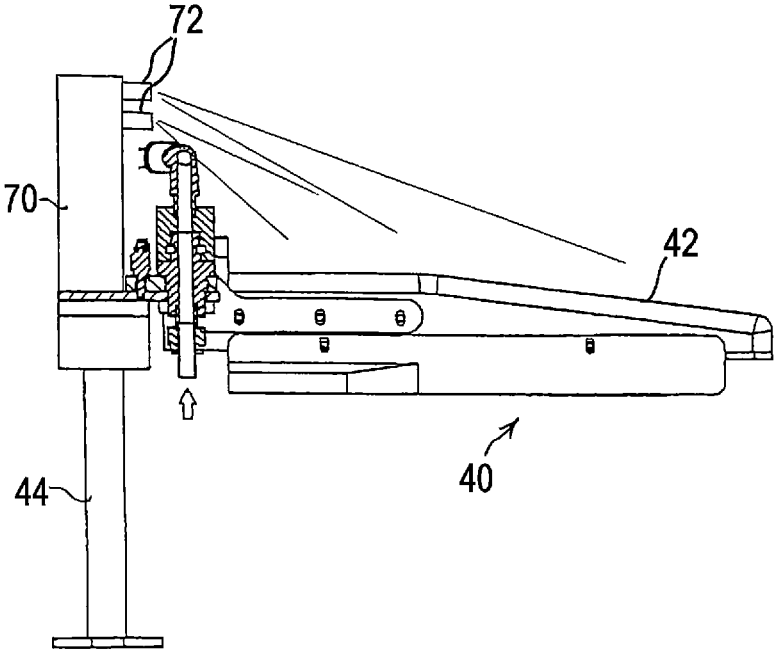
FIG. 4 is a front view showing spray nozzles and an atomizer provided in the polishing apparatus shown in FIG. 1.

As shown in FIG. 4, a bracket 70 is coupled to the upper end of the atomizer pivot shaft 44 so that the bracket 70 rotates together with the atomizer pivot shaft 44. Spray nozzles 72 are mounted to the bracket 70. These spray nozzles 72 are provided for spraying a cleaning liquid onto the atomizer cover 42 in its entirety both when the atomizer cover 42 is in the cleaning position and when the atomizer cover 42 is in the retreated position. Two spray nozzles 72 are provided in the illustrated embodiment.

Figure 5:
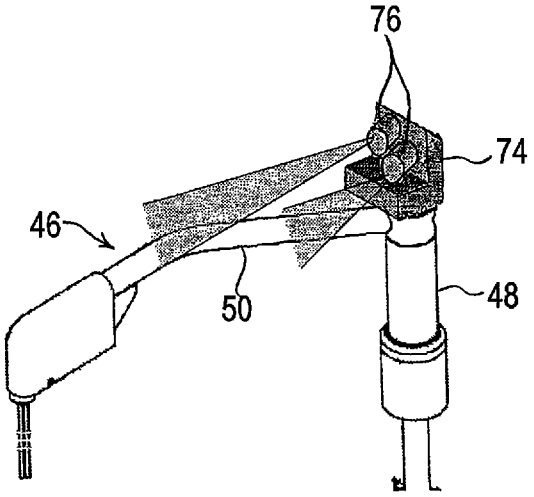
FIG. 5 is a perspective view showing spray nozzles and a polishing liquid supply nozzle provided in the polishing apparatus shown in FIG. 1.

As shown in FIG. 5, a bracket 74 is coupled to the upper end of the nozzle pivot shaft 48 so that the bracket 74 rotates together with the nozzle pivot shaft 48. Spray nozzles 76 are mounted to the bracket 74. These spray nozzles 76 are provided for spraying a cleaning liquid onto the polishing liquid supply nozzle 46 in its entirety, i.e., the outer surface of the pipe 50, when the supply orifice 46*a* of the polishing liquid supply nozzle 46 is in the retreated position beside the polishing table 12. Two spray nozzles 76 are provided in the illustrated embodiment.

The operations of the above-described spray nozzles 54, 56, 58, 60, 62, 64, 66, 72, 76, including the start and stop of spraying of the cleaning liquid, are controlled by the operation controller 5.

An operational sequence of the above-described polishing apparatus will now be described. The operational sequence is controlled by the operation controller 5 according to an operation recipe that is preset in the operation controller 5. When the top ring 14 is in the substrate transfer position, the top ring 14 receives a substrate. The top ring 14 is then moved to the polishing position above the polishing table 12. While the top ring 14 is rotating the substrate, the top ring 14 lowers the substrate and brings the substrate into contact with the polishing surface 10*a* of the rotating polishing pad 10, so that the substrate is polished. During the polishing of the substrate, the polishing liquid is supplied onto the polishing surface 10*a* from the polishing liquid supply nozzle 46 that has been moved from the retreated position to the polishing liquid supply position.

After the polishing of the substrate is terminated, the top ring 14 is raised and then moved to the substrate transfer position beside the polishing table 12. The polished substrate is transferred for the next process step. Simultaneously, the polishing liquid supply nozzle 46 is moved from the polishing liquid supply position to the retreated position.

After the polishing of the substrate is terminated, the dresser 20 is moved from the retreated position to the dressing position. While the dresser 20 is rotated, the dresser 20 is lowered to bring its lower surface into contact with the polishing surface 10*a* of the rotating polishing pad 10, thereby rubbing and dressing the polishing surface 10*a*. After the dressing of the polishing surface 10*a* is terminated, the dresser 20 is moved from the dressing position to the retreated position.

Further, the atomizer 40 is moved from the retreated position to the cleaning position. The cleaning fluid is then ejected from the atomizer 40 onto the polishing surface 10*a* of the polishing pad 10, thereby cleaning the polishing surface 10*a*. After the cleaning of the polishing surface 10*a* is terminated, the atomizer 40 is moved from the cleaning position to the retreated position. Although the atomizer 40 in this embodiment is configured to be movable from the cleaning position to the retreated position, the atomizer 40 may be fixed at the cleaning position.

When the top ring 14 is in the substrate transfer position, the cleaning liquid is sprayed onto the upper surface of the top ring 14 from the top ring spray nozzle 58 disposed obliquely above the top ring 14 and, at the same time, the cleaning liquid is sprayed onto the outer surface of the top ring head cover 24 from the upper spray nozzle 60 and the side spray nozzle 62, which are disposed around the top ring head cover 24, thereby keeping the upper surface of the top ring 14 and the outer surface of the top ring head cover 24 in a wet state with the cleaning liquid. Since these surfaces are kept in a wet state with the cleaning liquid, the polishing liquid, when it comes into contact with the wet surfaces, can be prevented from being attached to and dried on these surfaces. Further, since the cleaning liquid is sprayed from the top ring spray nozzle 58, the upper spray nozzle 60, and the side spray nozzle 62 when the top ring 14 is in the substrate transfer position, the cleaning liquid that has been once sprayed does not fall onto the polishing pad 10, and therefore does not affect the polishing performance of the polishing pad 10.

The spraying of the cleaning liquid from the top ring spray nozzle 58, the upper spray nozzle 60, and the side spray nozzle 62 is stopped before the top ring 14 moves from the substrate transfer position to the polishing position. In this manner, the operation controller 5 controls the start and stop of spraying the cleaning liquid from the spray nozzles 58, 60, 62 based on the position of the top ring 14.

When the dresser 20 is in the retreated position beside the polishing table 12, the cleaning liquid is sprayed onto the outer surfaces of the dresser head covers 30*a*, 30*b*, 30*c* from the upper spray nozzle 64 and the side spray nozzle 66 disposed around the dresser head covers 30*a*, 30*b*, 30*c*, thereby keeping the outer surfaces of the dresser head covers 30*a*, 30*b*, 30*c* in a wet state. By thus keeping the surfaces in a wet state with the cleaning liquid, the polishing liquid, when it comes into contact with the wet surfaces, can be prevented from being attached to and dried on the surfaces.

The spraying of the cleaning liquid from the upper spray nozzle 64 and the side spray nozzle 66 is stopped before the dresser 20 moves from the retreated position to the dressing position. The operation controller 5 thus controls the start and stop of spraying the cleaning liquid from the upper spray nozzle 64 and the side spray nozzle 66 based on the position of the dresser 20.

The cleaning liquid is sprayed from the spray nozzles 72 onto the outer surface of the atomizer cover 42 when a substrate is not being polished, e.g., when the polishing surface 10*a* is being cleaned with the cleaning fluid, such as the mixed fluid or the liquid, sprayed from the atomizer 40 in the cleaning position, or when the polishing surface 10*a* is being dressed by the dresser 20 while the atomizer 40 is in the retreated position. By thus keeping the outer surface of the atomizer cover 42 in a wet state with the cleaning liquid, the polishing liquid, when it comes into contact with the wet surface, can be prevented from being attached to and dried on the surface.

In particular, since the cleaning liquid is sprayed from the spray nozzles 72 onto the outer surface of the atomizer cover 42 when the polishing surface 10*a* is being cleaned with the cleaning fluid sprayed from the atomizer 40, the cleaning fluid that has bounced off the polishing surface 10*a* can be prevented from attaching to the atomizer cover 42.

The cleaning liquid is not sprayed onto the atomizer cover 42 when a substrate is being polished on the polishing pad 10. In this manner, the operation controller 5 controls the start and stop of spraying of the cleaning liquid from the spray nozzles 72 based on whether a substrate is being polished or not.

As described above, the atomizer 40 may be fixed at the cleaning position and the spray nozzles 72 may spray the cleaning liquid onto the outer surface of the atomizer cover 42 when a substrate is not being polished. The cleaning liquid that covers the atomizer cover 42 can prevent a liquid, which has been scattered from the polishing pad 10 during dressing, from contacting the atomizer 40. Although the cleaning liquid that has been sprayed from the spray nozzles 72 falls onto the polishing pad 10, the fallen cleaning liquid is removed by the cleaning fluid that is being supplied simultaneously from the atomizer 40 to the polishing surface 10*a* and therefore does not remain on the polishing pad 10.

The cleaning liquid is sprayed from the spray nozzles 76 onto the polishing liquid supply nozzle 46, i.e., the pipe 50, when the polishing liquid supply nozzle 46 is in the retreated position and a substrate is not being polished, e.g., when the polishing surface 10*a* is being cleaned with the cleaning fluid, such as the mixed fluid or the liquid, sprayed from the atomizer 40, or when the polishing surface 10*a* is being dressed by the dresser 20. By thus keeping the outer surface of the polishing liquid supply nozzle 46, i.e., the pipe 50, in a wet state with the cleaning liquid, the polishing liquid, when it comes into contact with the wet surface, can be prevented from being attached to and dried on the surface.

The spraying of the cleaning liquid from the spray nozzles 76 is stopped before the polishing liquid supply nozzle 46 moves from the retreated position to the polishing liquid supply position. In this manner, the operation controller 5 controls the start and stop of spraying the cleaning liquid from the spray nozzles 76 based on the position of the polishing liquid supply nozzle 46.

In this embodiment the polishing liquid supply nozzle 46 is configured to be movable between the polishing liquid supply position and the retreated position. However, as with the above-described atomizer 40, the polishing liquid supply nozzle 46 may be fixed at the polishing liquid supply position. In this case, the cleaning liquid may be sprayed onto the polishing liquid supply nozzle 46 in the polishing liquid supply position to keep it in a wet state e.g., when the polishing surface 10*a* is being cleaned with the cleaning fluid sprayed from the atomizer 40 or when the polishing surface 10*a* is being dressed by the dresser 20.

When a substrate is not being polished, the cleaning liquid is sprayed from the ceiling spray nozzles 54 onto the ceiling 52*a* of the chamber 52, and sprayed from the surrounding wall spray nozzles 56 onto the surrounding wall 52*b* of the chamber 52, thereby keeping the ceiling 52*a* and the surrounding wall 52*b*, constituting the inner surface of the chamber 52, in a wet state. By thus keeping the inner surface in a wet state, the polishing liquid, when it comes into contact with the wet surface, can be prevented from being attached to and dried on the surface.

The cleaning liquid is not sprayed onto the ceiling 52*a* and the surrounding wall 52*b* of the chamber 52 when a substrate is being polished on the polishing pad 10. The operation controller 5 thus controls the start and stop of spraying the cleaning liquid from the ceiling spray nozzles 54 and the surrounding wall spray nozzles 56 based on whether a substrate is being polished or not.

Figure 6:
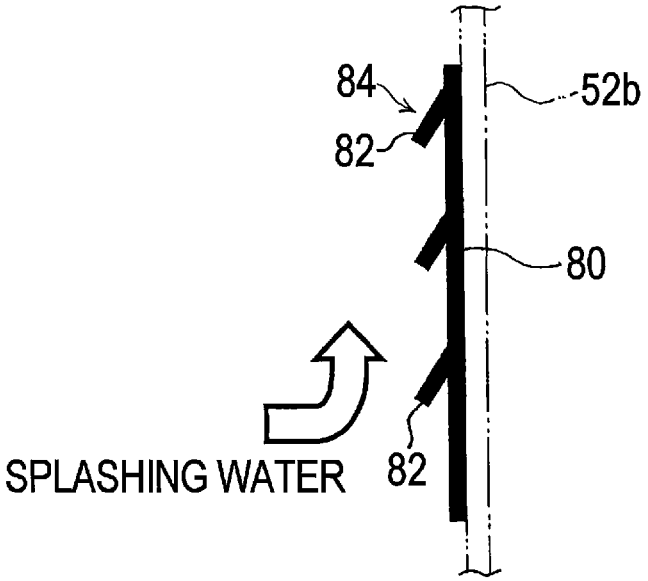
FIG. 6 is a cross-sectional view showing a waterproof plate provided on a surrounding wall of a chamber.

As shown in FIG. 6, a waterproof plate 84 may be provided at a predetermined position on the surrounding wall 52*b* of the chamber 52. The waterproof plate 84 includes a flat support plate 80 and a plurality of return plates 82 mounted to the support plate 80 at predetermined intervals along the vertical direction. Each return plate 82 is inclined downward. The thus-constructed waterproof plate 84 can prevent bouncing of air flow coming from the polishing pad 10.

According to the polishing apparatus of this embodiment, the constituent parts disposed around the polishing table 12, such as the upper surface of the top ring 14, the outer surface of the top ring head cover 24, and the outer surfaces of the dresser head covers 30*a*, 30*b*, 30*c*, can be kept in a wet state without any influence on processing, including polishing of the substrate. This structure can prevent the polishing liquid from being attached to and dried on the constituent parts disposed around the polishing table 12, thus preventing the dried polishing liquid from falling onto the polishing table 12 and causing a scratch on the substrate.

Operations of the start and stop of spraying of the cleaning liquid from all of the above-described cleaning nozzles are carried out according to the operation recipe that is set in the operation controller 5. The cleaning liquid, supplied from any of the spray nozzles onto a constituent part, can keep the constituent part in a wet state even when the polishing apparatus is in an idling operation (or a standby operation). The "idling operation" herein refers to a standby operation performed when polishing of a substrate is not carried out for a relatively long period of time. One example of the idling operation is a standby operation performed during a period of time from the completion of polishing of one lot of substrates to the start of polishing of the next lot of substrates.

In order to more effectively prevent the attachment of the polishing liquid, a water-repellent coating material may be applied to some or all of the constituent parts disposed around the polishing table 12.

Figure 7:
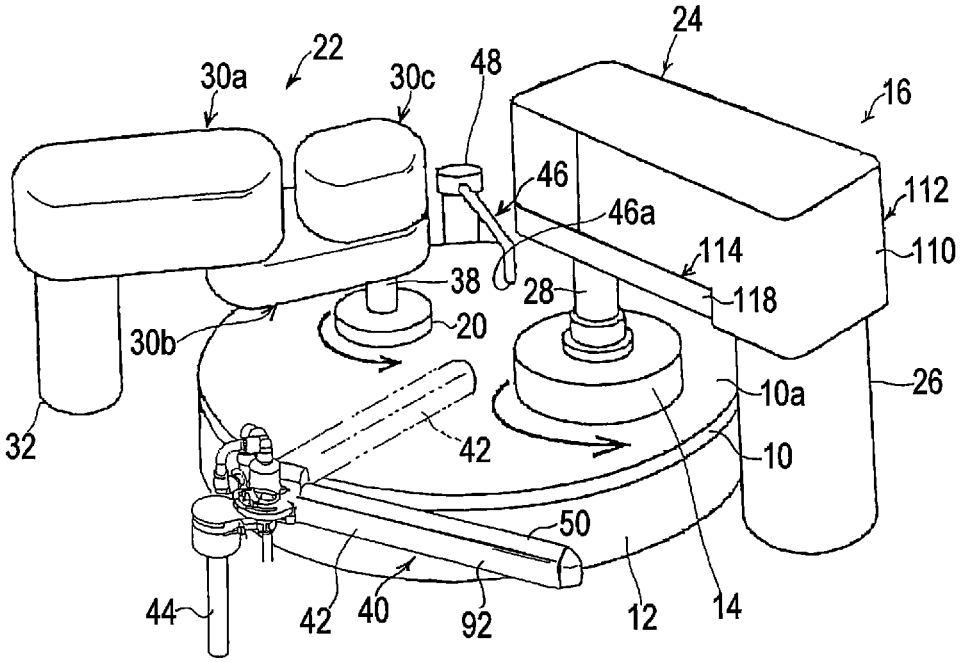
FIG. 7 is a perspective view showing the polishing apparatus according to another embodiment of the present invention.

FIG. 7 is a perspective view showing the polishing apparatus according to another embodiment of the present invention. With reference to the construction and the operation of this embodiment which are the same as those of the above-described embodiment shown in FIG. 1, a duplicate description thereof will be omitted. Depiction of the operation controller 5 is omitted in FIG. 7.

As shown in FIG. 7, atomizer 40 includes an atomizer head 89 (see FIG. 8) for spraying (or ejecting) a cleaning fluid, such as a liquid (e.g., pure water) or a mixed fluid of a liquid (e.g., pure water) and a gas (e.g., nitrogen gas), in a mist form onto the polishing surface 10*a* of the polishing pad 10 to clean the polishing surface 10*a*, and atomizer cover 42 that covers an upper surface of the atomizer head 89. A large number of spray nozzles 89*a* (see FIG. 8) for emitting the cleaning fluid downward are provided in a lower surface of the atomizer head 89 at predetermined intervals in the longitudinal direction of the atomizer head 89. The atomizer 40 is coupled to the upper end of the atomizer pivot shaft 44 so that, as the atomizer pivot shaft 44 rotates, the atomizer 40 pivots between the retreated position beside the polishing table 12, shown by the solid line in FIG. 7, and the cleaning position above the polishing table 12, shown by the imaginary line in FIG. 7.

Figure 8:
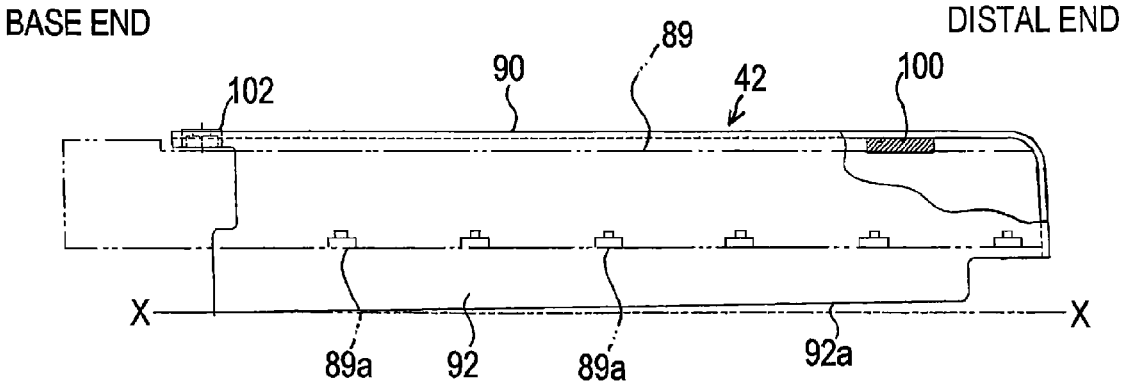
FIG. 8 is a front view of an atomizer cover, with an atomizer head depicted by imaginary line.
Figure 9:
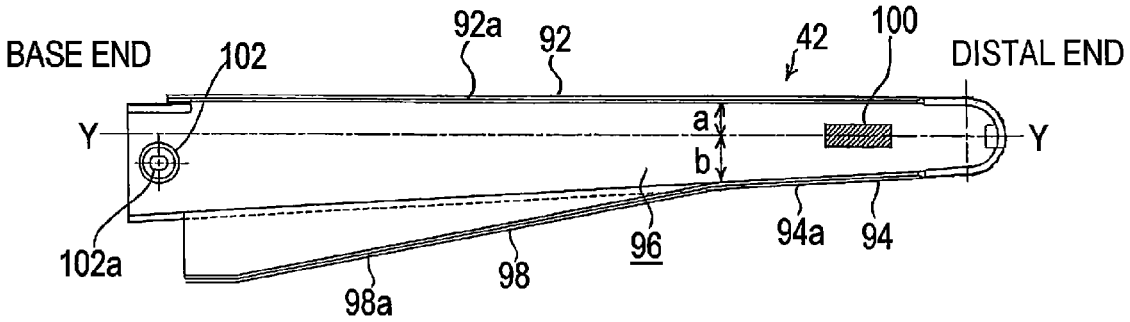
FIG. 9 is a bottom view of the atomizer cover.
Figure 10:
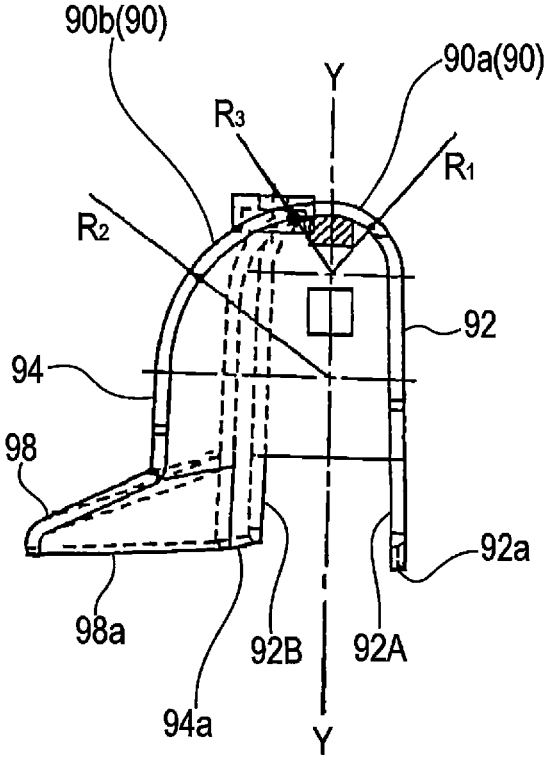
FIG. 10 is a left side view of the atomizer cover of FIG. 8.
Figure 11:
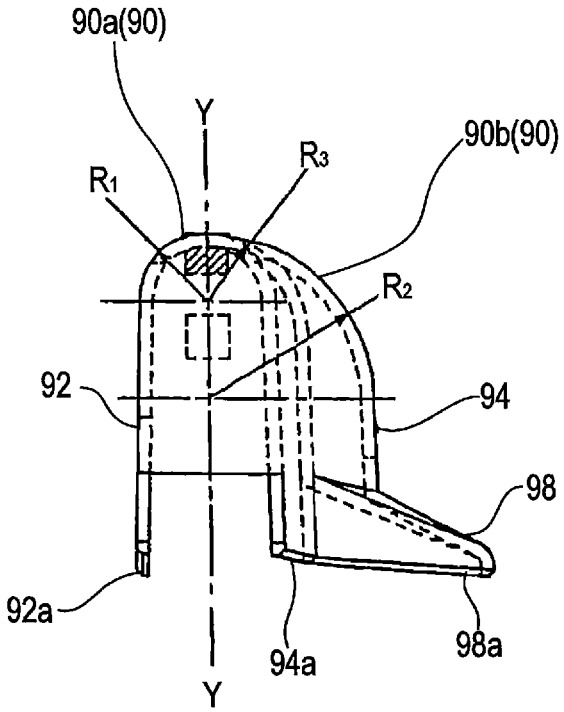
FIG. 11 is a right side view of the atomizer cover of FIG. 8.

FIGS. 8 through 11 show the atomizer cover 42. In FIGS. 8 and 9, the left side of the atomizer cover 42 is a base end of the atomizer cover 42, and the right side of the atomizer cover 42 is a distal end of the atomizer cover 42. As shown in FIGS. 8 through 11, the atomizer cover 42 has a first top plate 90*a* having a vertical cross section in a shape of ¼ circle whose radius $R_1$ is constant, and a second top plate 90*b* having a vertical cross section in a shape of ¼ circle whose radius decreases gradually from the base end toward the distal end, i.e., a radius $R_2$ at the base end is larger than a radius $R_3$ at the distal end ($R_2>R_3$). A top portion of the first top plate 90*a* and a top portion of the second top plate 90*b* are connected to each other to constitute a semicylindrical top plate 90 having a semicylindrical shape. The semicylindrical top plate 90 has a semicircular vertical cross section. The atomizer cover 42 has two side plates, i.e., a first side plate 92 and a second side plate 94, continuously extending vertically downward from both lower ends of the semicylindrical top plate 90. An upper end of the first side plate 92 is integrally connected to the lower end of the first top plate 90*a*, and an upper end of the second side plate 94 is integrally connected to the lower end of the second top plate 90*b*.

The first top plate 90*a*, the second top plate 90*b*, and the side plates 92, 94 form an open-bottom space 96 inside the atomizer cover 42. A vertical plane Y-Y represents an imaginary vertical plane that vertically passes through the top portions of the first top plate 90*a* and the second top plate 90*b* (i.e., the top portion of the semicylindrical top plate 90). In the interior space 96 of the atomizer cover 42, a distance "a" from the vertical plane Y-Y to the first side plate 92 is constant, whereas a distance "b" from the vertical plane Y-Y to the second side plate 94 decreases gradually from the base end toward the distal end. The interior space 96 of the atomizer cover 42 is asymmetric with respect to the vertical plane Y-Y. As shown in FIG. 8, the atomizer head 89 is housed in the space 96 in such a state that the upper surface of the atomizer head 89 is covered with the atomizer cover 42. The atomizer head 89 has the spray nozzles 89*a* for spraying the cleaning fluid, such as the liquid (e.g., pure water) or the mixed fluid of a liquid (e.g., pure water) and the gas (e.g., nitrogen gas), in a mist form onto the polishing surface 10*a* of the polishing pad 10 to clean the polishing surface 10*a*.

While in this embodiment the first top plate 90*a* and the second top plate 90*b*, each having the vertical cross section of ¼ circle, are connected together at their top portions to form the semicylindrical top plate 90, a first top plate and a second top plate, each having a vertical cross section in a shape of arc, may be connected to each other at their top portions to form a semicylindrical top plate.

A projecting portion 98, whose amount of outward projection decreases gradually from the base end toward the distal end, is formed integrally on the second side plate 94 that is connected to the second top plate 90*b*. The projecting portion 98 functions to prevent the cleaning fluid, which has been sprayed from the spray nozzles 89*a* onto the polishing pad 10 and bounced off the polishing pad 10, from diffusing in the chamber 52 (see FIG. 2). The lower end surface 94*a* of the second side plate 94, in its portion where the projecting portion 98 is not formed, and a lower end surface 98*a* of the projecting portion 98 are connected continuously. Although in this embodiment the projecting portion 98 is provided only on the second side plate 94 connected to the second top plate 90*b*, it is possible to additionally provide a projecting portion on the first side plate 92 connected to the first top plate 90*a*.

As shown in FIG. 8, the lower end surface 92*a* of the first side plate 92 is inclined downward with respect to a horizontal plane X-X in a direction from the distal end toward the base end of the atomizer cover 42. Similarly, the lower end surface 94*a* of the second side plate 94 and the lower end surface 98*a* of the projecting portion 98, connected to each other, are inclined downward in a direction from the distal end toward the base end of the atomizer cover 42.

The atomizer cover 42 can be produced by integral molding of a resin, such as polyvinyl chloride. A draft angle in integral molding of the resin is, for example, 1.5°. Thus, in FIG. 10, a vertical portion 92A of the first side plate 92 connected to the first top plate 90*a* and a vertical portion 92B of the second side plate 94 connected to the second top plate 90*b* are not parallel to each other, and a distance between the vertical portion 92A and the vertical portion 92B gradually increases along a downward direction. The atomizer cover 42 thus has a shape that can be formed by integral molding of a resin.

A rectangular "Norseal" 100 is mounted to a distal-end-side back surface of the top plate 90 of the atomizer cover 42, and a bolt mount 102 is mounted in a cutout which is formed in the base end. An elongated hole 102*a*, extending in the longitudinal direction of the atomizer cover 42, is formed in the bolt mount 102.

The atomizer cover 42 is fixed with one bolt (not shown) at a predetermined position by inserting a shank of the bolt into the elongated hole 102*a* of the bolt mount 102, and fastening the bolt to bring a head of the bolt into contact with the bolt mount 102. The mounting position of the atomizer cover 42 in its longitudinal direction can be finely adjusted through the elongated hole 102*a*.

The atomizer cover 42 has a smooth shape with no angular portion so that a liquid, which has come into contact with the inner or outer surface, can easily run down. Such a shape can prevent contamination of the atomizer cover 42 with a liquid including the polishing liquid. Moreover, even if the liquid including the polishing liquid has adhered to the atomizer cover 42, the liquid can be easily removed. Furthermore, the atomizer cover 42, because of its smooth shape with no angular portion, can be produced by integral molding of a resin.

As described above, the lower end surface 92*a* of the first side plate 92 connected to the first top plate 90*a* is inclined with respect to the horizontal plane X-X downwardly from the distal end toward the base end of the atomizer cover 42. Similarly, the lower end surface 94*a* of the second side plate 94 connected to the second top plate 90*b* and the lower end surface 98*a* of the projecting portion 98 are inclined downward from the distal end toward the base end of the atomizer cover 42. A liquid flows down from the semicylindrical top plate 90 to the side plates 92, 94 and also flows down the projecting portion 98 to reach the lower end surfaces 92*a*, 94*a* of the side plates 92, 94 and the lower end surface 98*a* of the projecting portion 98. Because the lower end surfaces 92*a*, 94*a*, 98*a* are inclined with respect to the horizontal plane X-X, the liquid flows on the lower end surfaces 92*a*, 94*a*, 98*a* in the direction from the distal end to the base end of the atomizer cover 42.

By providing the projecting portion 98 integrally on the second side plate 94 connected to the second top plate 90*b*, the atomizer cover 42 can be reinforced with the projecting portion 98.

Figure 12:
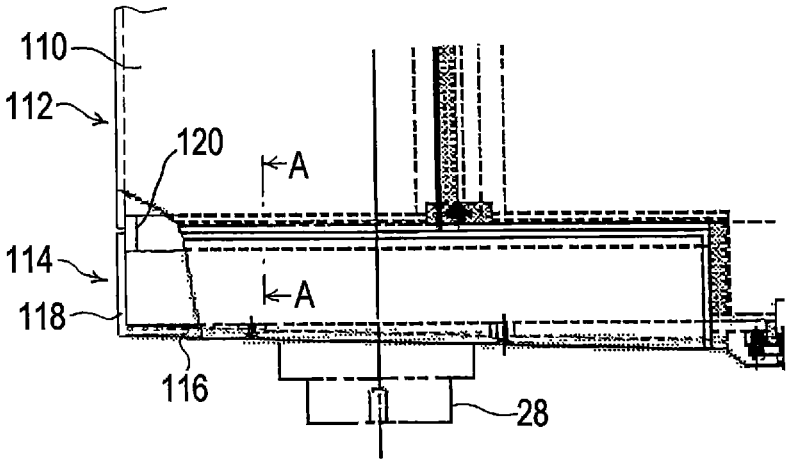
FIG. 12 is an enlarged front view of a lower cover of a top ring head cover.

As shown in FIG. 7, the top ring head cover 24 has a side cover 112 including a side plate 110, and a lower cover 114 that closes a bottom opening of the side cover 112. FIG. 12 shows the details of the lower cover 114. As shown in FIG. 12, the lower cover 114 includes a bottom plate 116 and a side plate 118. The side plate 118 extends upwardly from a peripheral portion of the bottom plate 116 and surrounds, together with the side plate 110 of the side cover 112, the top ring head 16. The top ring 14 is coupled to the lower end of the top ring drive shaft 28 that extends downward through the bottom plate 116 of the lower cover 114.

The bottom plate 116 of the lower cover 114 has such an inclination that, when the top ring 14 is in the polishing position above the polishing surface 10*a*, the bottom plate 116 is inclined downwardly toward a radially outward direction of the polishing table 12. Specifically, the bottom plate 116 of the lower cover 114 is inclined downward in a direction toward the top ring head pivot shaft 26.

The polishing liquid that has entered the interior of the top ring head cover 24 reaches the bottom plate 116 of the lower cover 114, flows on the inclined bottom plate 116, and is collected in a place beside the polishing table 12. The polishing liquid can thus be prevented from contaminating the top ring head cover 24 and the top ring head 16, and dropping onto and contaminating the polishing surface 10*a*.

Figure 13:
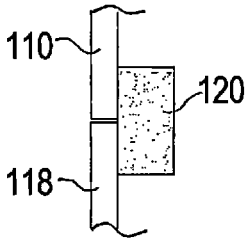
FIG. 13 is a cross-sectional view taken along line A-A in FIG. 12.

FIG. 13 shows an enlarged cross-sectional view taken along line A-A in FIG. 12. As shown in FIG. 13, the upper end surface of the side plate 118 of the lower cover 114 is in contact with or in proximity to the lower end surface of the side plate 110 of the side cover 112, and a "Norseal" 120 is attached to back surfaces of the side plate 118 and the side plate 110. A gap between these side plates 110, 78 is sealed by the Norseal 120. Such a structure makes it possible to locate a coupling portion between the side cover 112 and the lower cover 114 at a higher position than a corner between the side cover 112 and the lower cover 114. If the coupling portion between the side cover 112 and the lower cover 114 exists in the corner, the polishing liquid is likely to remain on the corner. The construction shown in FIG. 13 can solve such a drawback. Furthermore, the Norseal 120 can prevent intrusion of the polishing liquid into the top ring head cover 24.

Figure 14:
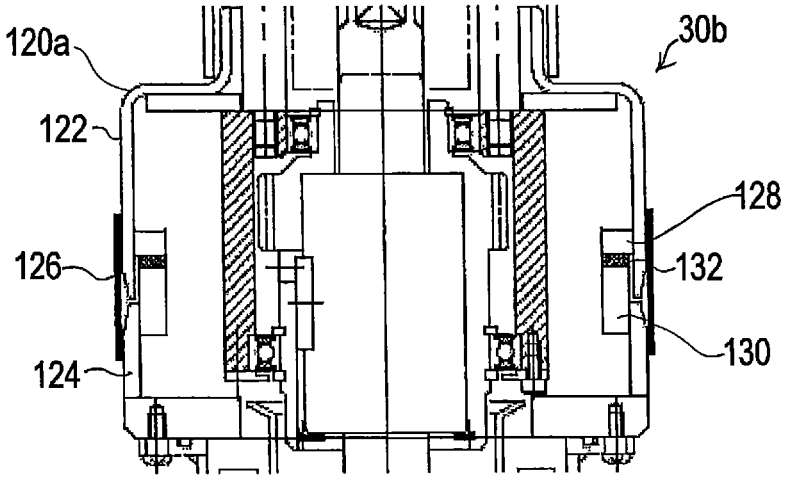
FIG. 14 is a vertical cross-sectional view of a second dresser head cover.

FIG. 14 shows a vertical cross-sectional view of the second dresser head cover 30*b*. As shown in FIG. 14, the second dresser head cover 30*b* includes an upper side plate 122 and a lower side plate 124 each having approximately a cylindrical shape. A lower end surface of the upper side plate 122 is in contact with or in proximity to an upper end surface of the lower side plate 124, and a tape 126 is attached to outer circumferential surfaces of the upper side plate 122 and the lower side plate 124. A gap between the upper side plate 122 and the lower side plate 124 is sealed by the tape 126. A buffer material 132 is disposed between a protrusion 128, mounted to an inner circumferential surface of the upper side plate 122, and a protrusion 130 mounted to an inner circumferential surface of the lower side plate 124. With such a structure, a coupling portion between the upper side plate 122 and the lower side plate 124 can be located at a higher position and, in addition, a liquid can be prevented from intruding into the second dresser head cover 30*b*.

A curved-surface portion 120*a*, which smoothly connects a vertical portion to a horizontal portion of the upper side plate 122, is formed at an upper portion of the upper side plate 122. The curved-surface portion 120*a* allows liquid droplets to flow smoothly on the outer surface of the upper side plate 122.

The first dresser head cover 30*a* may have the same construction as the second dresser head cover 30*b*.

Figure 15:
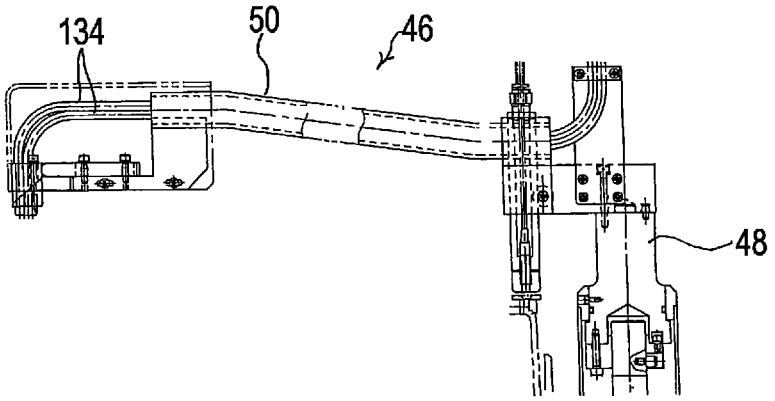
FIG. 15 is a perspective view showing details of the polishing liquid supply nozzle.

FIG. 15 shows the details of the polishing liquid supply nozzle 46. As shown in FIG. 15, the polishing liquid supply nozzle 46 includes the pipe 50 and a plurality of polishing liquid tubes 134 housed in the pipe 50. Such a structure can prevent intrusion of the polishing liquid into gaps between the polishing liquid tubes 134 and can enhance the cleaning efficiency of the polishing liquid supply nozzle 46.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a rotatable polishing table for supporting a polishing pad having a polishing surface;

an atomizer head configured to spray a cleaning fluid onto the polishing surface to clean the polishing surface; and an atomizer cover that covers an upper surface of the atomizer head, the atomizer cover including a semicylindrical top plate having a semicylindrical shape, and a first side plate and a second side plate extending downward from both lower ends of the semicylindrical top plate, the semicylindrical top plate including a first top plate having a vertical cross section in a shape of an arc whose radius is constant over its entire length from a base end to a distal end of the atomizer cover, and a second top plate having a vertical cross section in a shape of an arc whose radius decreases gradually from the base end toward the distal end of the atomizer cover, the first top plate and the second top plate being connected to each other at their top portions to constitute the semicylindrical top plate.

2. The polishing apparatus according to claim 1, wherein the semicylindrical top plate, the first side plate, and the second side plate are formed integrally from resin.

3. The polishing apparatus according to claim 1, wherein the first side plate and the second side plate have lower end surfaces, respectively, which are inclined downward from the distal end to the base end of the atomizer cover.

4. The polishing apparatus according to claim 1, wherein the second side plate is connected to the second top plate, and the second side plate is provided with a projecting portion projecting in a horizontal direction.

5. The polishing apparatus according to claim 1, further comprising:

a top ring head having a top ring configured to press a substrate against the polishing surface while holding and rotating the substrate; and a top ring head cover surrounding the top ring head, the top ring head cover including a side cover that surrounds the top ring head, and a lower cover that closes a bottom opening of the side cover, the lower cover including a bottom plate inclined downwardly toward a radially outward direction of the polishing table when the top ring is in a polishing position above the polishing table.

6. The polishing apparatus according to claim 5, wherein the lower cover includes a side plate which extends upwardly from a peripheral portion of the bottom plate and which is in contact with or in proximity to a side plate of the side cover.

* * * * *